US012304709B2

(12) United States Patent
Norkitis et al.

(10) Patent No.: US 12,304,709 B2
(45) Date of Patent: May 20, 2025

(54) SELF-VENTING LID FOR CONTAINERS

(71) Applicant: Silipint Partners LLC, Indianapolis, IN (US)

(72) Inventors: Mike Norkitis, Bend, OR (US); Alex Baires, Bend, OR (US)

(73) Assignee: Silipint Partners LLC, Indianapolis, IN (US)

( * ) Notice: Subject to any disclaimer, the term of this patent is extended or adjusted under 35 U.S.C. 154(b) by 67 days.

(21) Appl. No.: 18/155,169

(22) Filed: Jan. 17, 2023

(65) Prior Publication Data

US 2024/0239571 A1 Jul. 18, 2024

(51) Int. Cl.
*B65D 51/16* (2006.01)
*B65D 43/16* (2006.01)
*B65D 51/24* (2006.01)

(52) U.S. Cl.
CPC ..... *B65D 51/1644* (2013.01); *B65D 43/162* (2013.01); *B65D 51/246* (2013.01)

(58) Field of Classification Search
CPC ... B65D 51/644; B65D 43/162; B65D 51/246
USPC ..... 220/203.11
See application file for complete search history.

(56) References Cited

U.S. PATENT DOCUMENTS 1,865,764 A * 7/1932 Keenan ..... B65D 51/165 137/859
3,696,958 A * 10/1972 Lee ..... B65D 51/165 215/261
5,071,017 A * 12/1991 Stull ..... B65D 50/06 215/11.4
5,249,598 A * 10/1993 Schmidt ..... F16K 24/04 137/493.1
5,893,461 A * 4/1999 Walters ..... B65D 77/225 137/493
7,051,762 B2 * 5/2006 Haamer ..... B65D 77/225 426/118
9,289,323 B2 * 3/2016 Marton ..... A61F 7/103
9,976,661 B2 * 5/2018 Zhang ..... B65D 51/165
10,377,539 B2 * 8/2019 Fisch ..... B65D 51/1616
10,501,244 B2 * 12/2019 Bacher ..... B65D 51/165
10,708,986 B2 7/2020 Wiggins et al.
11,440,710 B2 * 9/2022 Scotton ..... B65D 51/1683
D975,448 S * 1/2023 Chan ..... D3/303
D1,008,744 S * 12/2023 Chen ..... D7/602
(Continued)

FOREIGN PATENT DOCUMENTS

EP 1612156 A1 1/2006
KR 10-1158674 6/2012
WO WO 98/008748 3/1998

*Primary Examiner* — Ernesto A Grano
(74) *Attorney, Agent, or Firm* — Woodard, Emhardt, Henry, Reeves & Wagner, LLP; William A. McKenna

(57) ABSTRACT

The present invention relates generally to self-venting food storage containers that release pressure build up inside the sealed container during storage or cooking. The silicone food storage container includes a venting aperture configured to release pressure build-up from within the container. The venting aperture is defined by a barrier and includes an area of silicone that is thinner than the thickness of the material of the lid, so any tear in the venting aperture will not tear past the circumference of the barrier. The silicone food storage container is also dishwasher safe, microwave safe, and, for the most part, unbreakable.

19 Claims, 6 Drawing Sheets

(56) References Cited

U.S. PATENT DOCUMENTS 11,987,435 B2* 5/2024 Soh ..... B32B 5/18
2004/0232026 A1 11/2004 Goeking et al.
2005/0247661 A1* 11/2005 Robertson ..... B65D 51/165 215/311
2008/0203096 A1 8/2008 Maxwell
2008/0251518 A1* 10/2008 Tee ..... B65D 81/343 220/373
2009/0166362 A1 7/2009 Olsson
2012/0267369 A1* 10/2012 Duvigneau ..... B65D 43/0204 220/795
2014/0163463 A1* 6/2014 Agbo ..... A61J 7/0046 215/396
2014/0174039 A1* 6/2014 DiMeo ..... A45C 11/20 220/574
2014/0311940 A1* 10/2014 Braveman ..... B65D 43/0231 206/524.6
2015/0368003 A1* 12/2015 Freedman ..... B65D 43/0216 220/315
2017/0144823 A1* 5/2017 Warman ..... B65D 53/02
2017/0203890 A1* 7/2017 Lenz ..... B65D 51/26
2018/0022496 A1* 1/2018 Pan ..... A61F 5/41 206/363
2019/0322406 A1* 10/2019 Makarchuk ..... B65D 1/26
2020/0255206 A1* 8/2020 Freedman ..... B65D 43/162
2021/0086958 A1* 3/2021 Tobias ..... B65D 81/3865
2021/0245935 A1* 8/2021 Dwork ..... B65D 77/046
2021/0316911 A1* 10/2021 Chen ..... B65D 51/20
2022/0002033 A1* 1/2022 Braude ..... B65D 25/56
2022/0315271 A1* 10/2022 Hirohashi ..... B65D 43/162
2023/0038511 A1* 2/2023 Piccioni ..... B65D 51/1655
2023/0067459 A1* 3/2023 Guirguis ..... B65D 55/024
2023/0210243 A1* 7/2023 Varale ..... A45D 40/221 220/836
2023/0234757 A1* 7/2023 Rostami ..... B65D 47/0828 220/833
2023/0331442 A1* 10/2023 Teillard ..... B65D 47/0838
2024/0002104 A1* 1/2024 Jones ..... B65D 21/086
2024/0025620 A1* 1/2024 Stoltz ..... B65D 55/16
2024/0092556 A1* 3/2024 Jones ..... A45C 11/20

* cited by examiner

SELF-VENTING LID FOR CONTAINERS

FIELD OF THE INVENTION

The present disclosure broadly concerns food storage containers. More specifically, the present disclosure relates to self-venting food storage containers.

BACKGROUND

The present invention is directed to improvements in food storage containers. Traditional food storage mechanisms include glass or plastic containers, some of which may self-seal, or covering food with aluminum foil or plastic wrap. However, these mechanisms present a number of shortcomings. For example, plastic containers may not be dishwasher and microwave safe. Additionally, glass containers are fragile and susceptible to breaking. Further, finding the correct lid to match the container presents its own set of problems.

These mechanisms can also fail to properly store food to keep it as fresh as possible. Aluminum foil and plastic wrap do not properly seal the food from surrounding air, which does not keep the food fresh. Conversely, traditional plastic or glass food storage containers can seal the food, but do not allow proper venting of gases that build-up over time (i.e., oxidation).

Lastly, traditional plastic or glass food storage containers do not allow for proper pressure relief during cooking (i.e., microwave), such that the lid must be opened or removed, thereby allowing the dreaded microwave mess. During cooking, excess water vapor way increase pressure in the food storage container if the lid is not removed, leading to a potentially dangerous and at best messy situation.

Therefore, it is an object of the present invention to provide a self-venting sealed food storage container that will properly vent food as it is stored and properly vent food as it is cooked. It is a further object of the present invention to provide a food storage container that is semi-rigid and will not break while simultaneously being dishwasher and microwave safe. It is yet another object of the present invention to provide a food storage container having a lid and container constructed having a unitary construction.

SUMMARY OF THE INVENTION

The present disclosure includes certain embodiments for a self-venting food storage container. In certain embodiments of the present invention, a self-venting food storage container made of silicone includes a lid and a base that forms a receptacle for storing food. The container includes a venting aperture, such as on the lid, which is configured to release pressure (e.g., during storage or cooking) that may build-up in the sealed food storage container. The venting aperture is defined by a barrier configured to stop tearing of the lid in the event the venting aperture tears or rips. Further, the silicone material of the aperture is thinner than the silicone material of the lid, such that unintentional tearing of the slot of the venting aperture is confined to the area within the barrier.

Further objects, features and advantages of the present invention shall become apparent from the detailed drawings and descriptions provided herein. Each embodiment described is not intended to address every object described herein, and each embodiment does not include each feature described. Some or all of these features may be present in the corresponding independent or dependent claims, but should not be construed to be a limitation unless expressly recited in a particular claim.

DETAILED DESCRIPTION OF THE INVENTION

Figure 1:
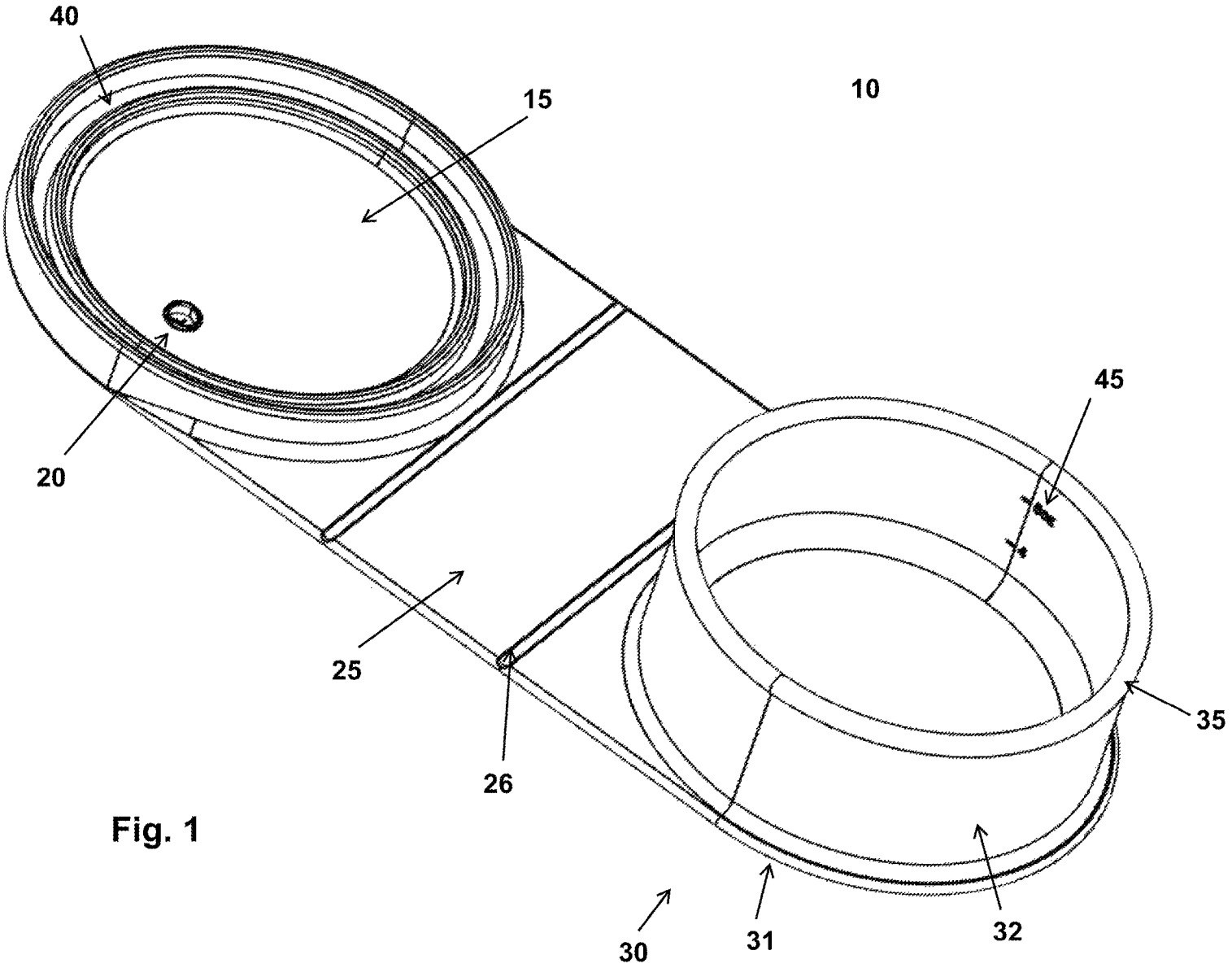
FIG. 1 is a top perspective view of a self-venting food storage container according to one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The present invention relates generally to food storage containers and more particularly self-venting food storage containers. The self-venting food storage containers of the present invention are formed from pliable materials, such as elastomer, and more specifically silicone. These containers can take any shape (e.g., circular, rectangular, etc.) and can come in various sizes (e.g., 8 oz., 10 oz., etc.) having various heights. Other shapes and sizes of self-venting food storage containers are contemplated and desired to be protected. However, for purposes of illustration, the novel self-venting food storage container of the present invention will be described herein with respect to two exemplary embodiments.

Regardless of the shape or size, by being manufactured principally, and in some cases entirely, of pliable material, such as silicone, the self-venting food storage containers enjoy the following desirable characteristics: it is dishwasher safe, microwave safe, oven safe up to 450° F. in some forms and potentially up to temperature exceeding 600° F. in other forms, is flexible/pliable, and under normal circumstances—unbreakable. This material ensures that the food storage containers of the present disclosure can safely travel without fear of breaking or injury.

According to FIG. 1, an illustrative self-venting food storage container 10 is shown from a perspective view. As illustrated, container 10 includes a lid 15, a connecting member 25, and a receptacle 30. The lid 15 further includes a venting aperture (discussed in more detail below with respect to FIGS. 5 and/or 6) configured to allow excess pressure to evacuate from the food storage container 10 when the container is sealed/closed. Venting aperture 20 is designed as an automatic normally closed valve, such that absent a pressure differential the sealed container remains sealed by venting aperture 20. The lid also includes a recess 40. The recess is configured to have an inner and outer lip on opposite sides of the recess 40. The inside surface (i.e., surface on the inside of the container when the lid is closed) of lid 15 (e.g., the area within the circumference of the inner edge of recess 40) may be polished to have a smooth texture for ease of cleaning and/or aesthetic appearance.

In one embodiment, the food storage container 10 includes a connecting member 25 which is configured to permanently connect the lid 15 to the receptacle 30. The connecting member 25, in this embodiment, is formed as a continuous piece of silicone extending from the receptacle 30 to the lid 15. In other embodiments, the connecting member 25 may be made from other pliable materials. In some embodiments, connecting member 25 may include one or more folding lines 26. Folding lines 26 are lines across the width of container 10, as depicted, that are made of scores in or a thinner portion of silicone than connecting member 25. The folding lines 26 are configured to facilitate folding of connecting member 25 such that it is easier to place and seal lid 15 on receptacle 30.

In other embodiments, the food storage container 10 and the lid 15 may not be connected to one another, and the connecting member 25 may be omitted. In such embodiments, the lid 15 and receptacle 30 may be separate, while still usable with the lid 15 sealing the receptacle 30. Alternatively, if connectivity is desired, some other manner of connecting the lid 15 and receptacle 30 may be provided.

The receptacle 30 includes a base 31 and at least one sidewall 32 (depending on the shape of the receptacle). The sidewall 32 extends from base 31 and forms the interior cavity of receptacle 30. The distal end of sidewall 32 includes a rim 35. In this embodiment, rim 35 is annular in shape and defines the opening of receptacle 30. Rim 35 is configured to selectively mate with recess 40 of lid 15 by fitting between the inner and outer lips of recess 40. Mating recess 40 of lid 15 with the rim 35 of receptacle 30 closes the container 10 and provides an air-tight seal within the cavity of receptacle 30. It should be appreciated that other sealing mechanisms may be used and are contemplated for use in conjunction with the present invention, including a snap fit, friction fit and selectively closeable clasps.

The interior surface of receptacle 30 (i.e., the inside surface of sidewall 32) may be polished to have a smooth surface finish, similar to the smooth surface finish of the inside surface of lid 15. The polished, smooth surfaces of sidewall 32 and lid 15 allow for easy cleaning and improve pouring of liquid (e.g., soup) into and out of container 10. Although not shown, it shall be appreciated that many different textures and patterns may be applied to the outside surfaces of sidewall 32 and lid 15 (and the remainder of container 10), such as to enhance its gripability, aesthetics, or to include a design element.

Figure 2:
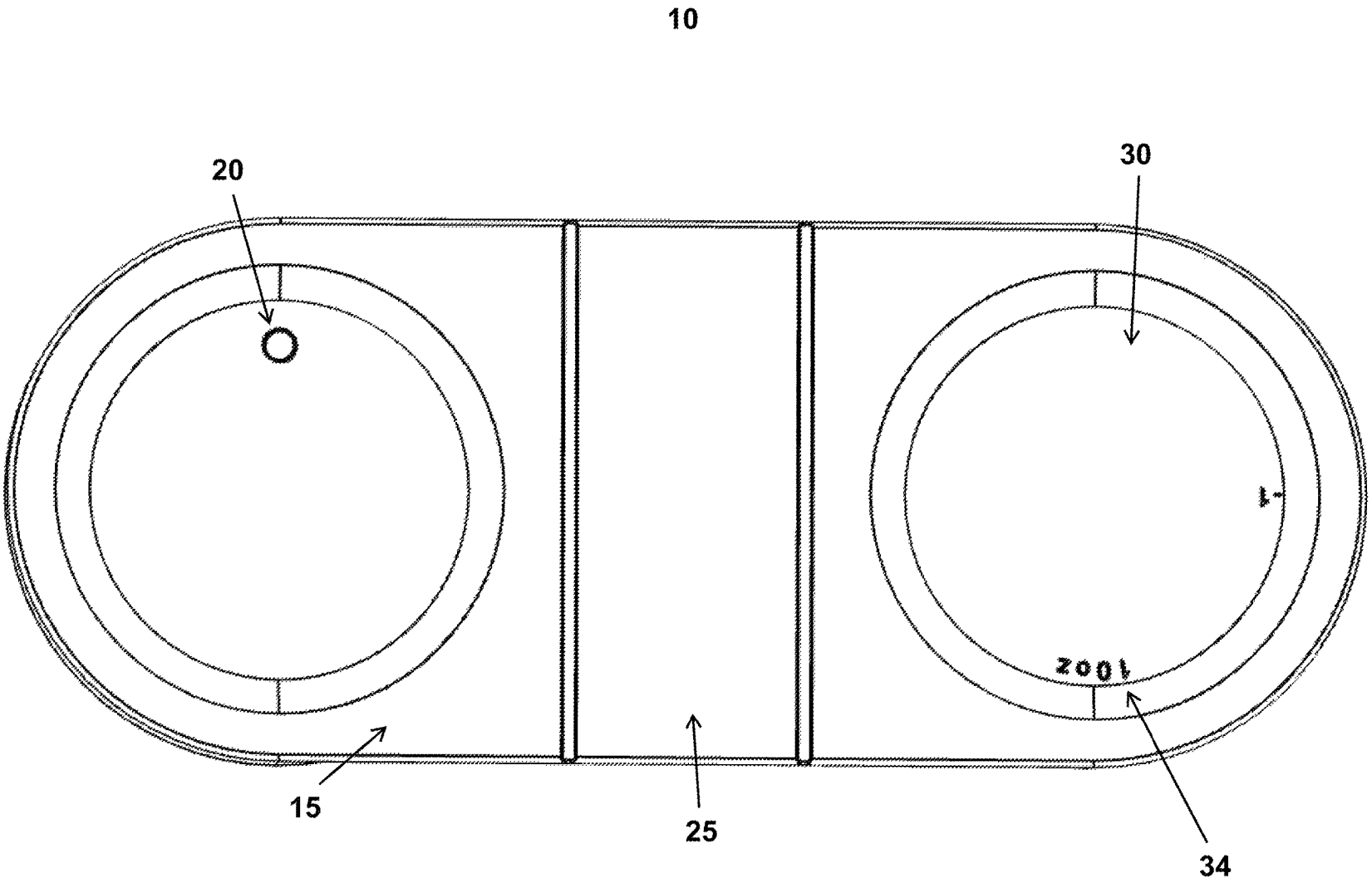
FIG. 2 is a bottom view of the self-venting food storage container of FIG. 1.

The interior surface of sidewall 32 may also include graduated marks 45 indicating the capacity of container 10. For example, graduated marks 45 may indicate the capacity of container 10 in ounces or some other selected unit of measurement. In this embodiment, graduated marks 45 display graduated lines of 4 ounces and 8 ounces within a 10-ounce container 10. Further, container 10 may include graduated marks 45 in both ounces and some other volumetric units. For example, one side of sidewall 32 may includes graduated marks 45 in ounces, and another portion of sidewall 32 (e.g., 90 or 180 degrees from graduated marks 45) may indicate graduated marks (not shown) in another selected measure of volume Turning to FIG. 2, a bottom view of the container 10 of FIG. 1 is shown. As shown, the bottom of receptacle 30 may include the total capacity of container 10 via insignia 34. Other information may also be displayed on the outer surfaces of container 10. For example, a logo could be placed on the bottom surface of receptacle 30, the outer surface of lid 15, or the outer surface of connecting member 25.

Figure 3:
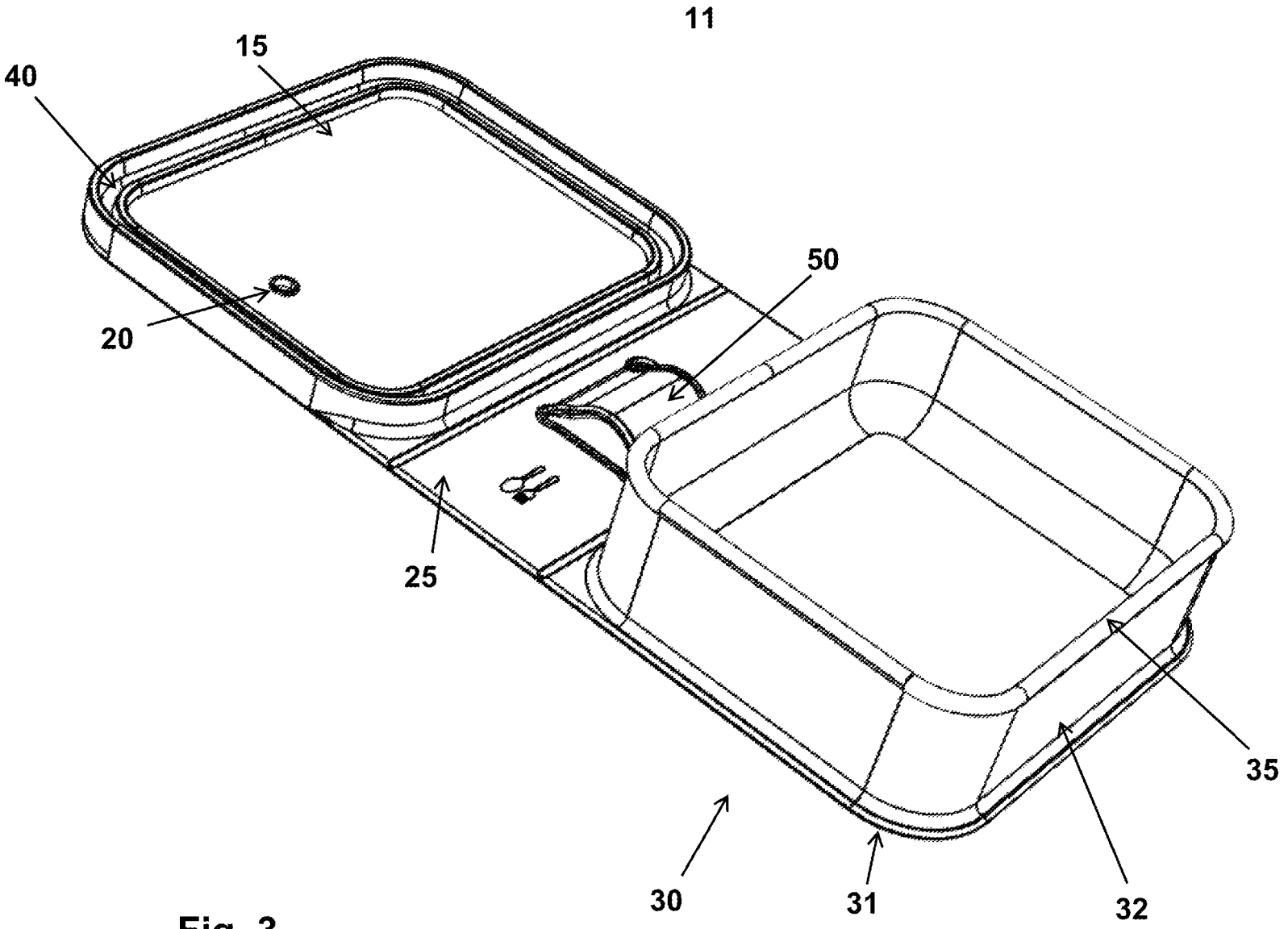
FIG. 3 is a top perspective view of a self-venting food storage container according to another embodiment of the present invention.

FIG. 3 is a perspective view of a second illustrative embodiment of the present invention. Similar to the first embodiment, container 11 includes a lid 15, a connecting member 25, and a receptacle 30. The lid similarly includes a venting aperture 20 and recess 40.

Container 10 has a rectangular receptacle 30 configured of a base 31 and sidewalls 32. The shape of the sidewalls 32 are the same as base 31 and lid 15 (i.e., rectangular). The distal end of sidewalls 32 form a rim 35 for selectively mating to recess 40.

As shown in FIG. 3, connecting member 25 may include utensil receptacle 50. Utensil receptacle 50 is configured of slits in connecting member 25, which creates space where utensils can be placed and stored. For example, utensils can be slid into utensil receptacle 50 while the container 11 is in an open configuration. Then, once container 11 is closed and connecting member 25 is folded, utensil receptacle 50 becomes taut, which securely holds the utensils in place. Utensil receptacle 50 is made of pliable material (e.g., silicone), which allows for storage of utensils on either the outer surface or inner surface of connecting member 25.

Figure 4:
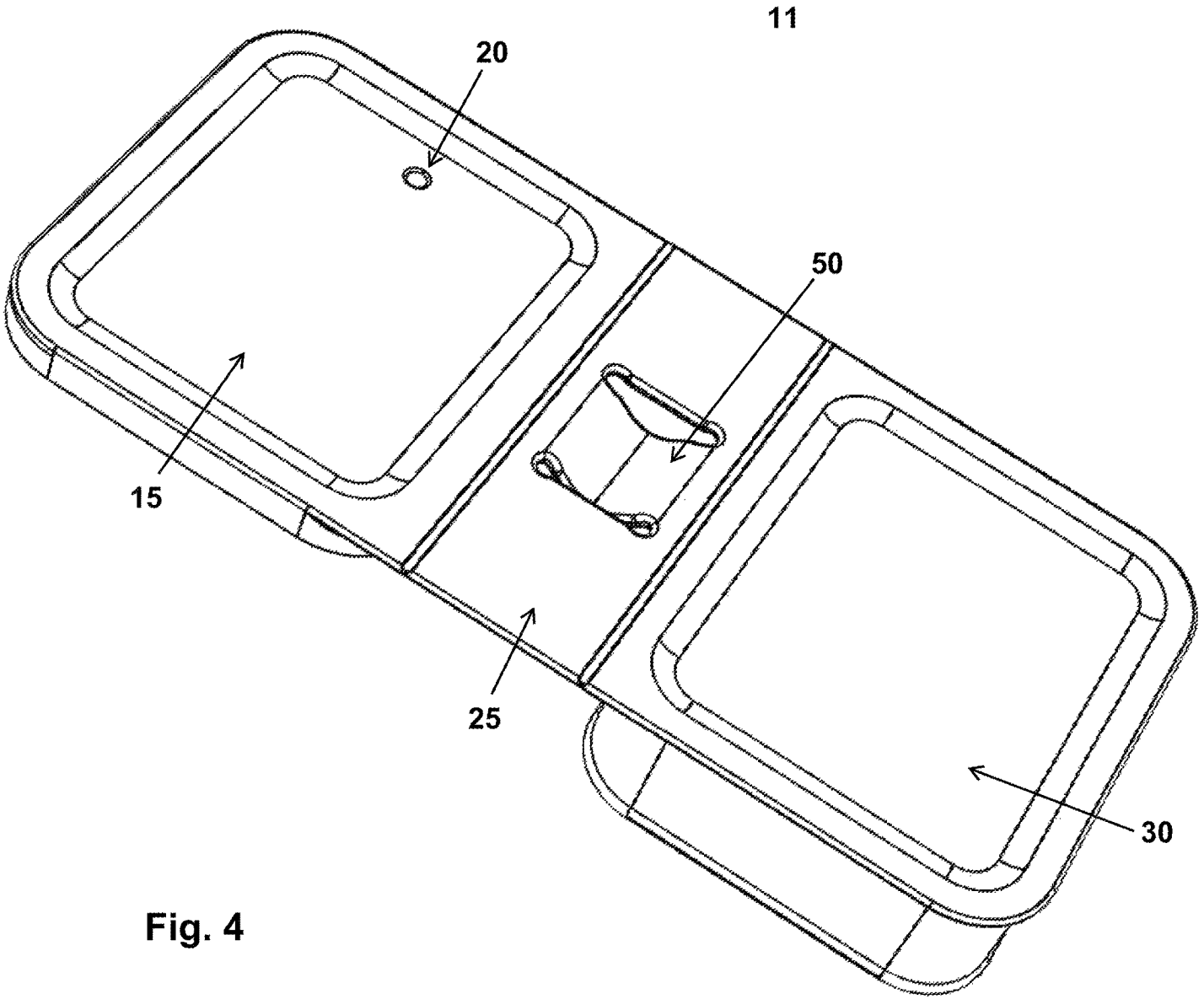
FIG. 4 is a bottom perspective view of the self-venting food storage container of FIG. 3.

FIG. 4 is a bottom perspective view of the container 11 of FIG. 3. As illustrated, utensil receptacle 50 may not lie in the same plane as connecting member 25, such that utensils can fit between utensil receptacle 50 and connecting member 25.

Figure 5:
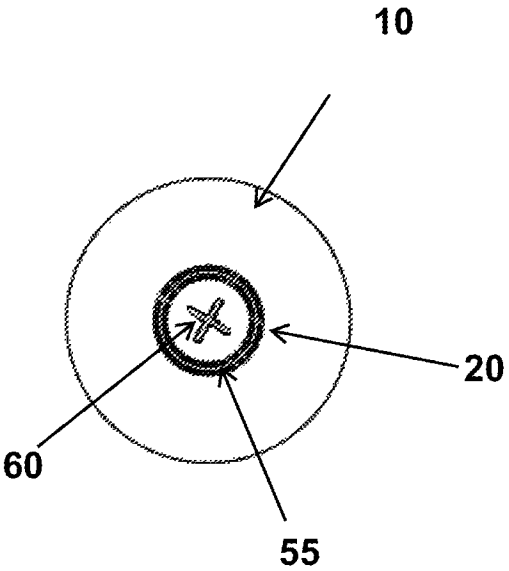
FIG. 5 is a close-up view of a venting aperture according to one embodiment of the present invention.

FIG. 5 is a zoomed-in view showing only the venting aperture 20 of container 10 (or container 11) from the perspective of the inner surface of the lid 15. As illustrated, venting aperture 20 is defined by a barrier/perimeter 55. The surface within barrier 55 comprises the venting aperture 20. In one form, the thickness of the material that comprises venting aperture 20 is thinner than the thickness of the material that comprises lid 15. Venting aperture 20 includes at least one linear slot 60 that is cut through the entire thickness of venting aperture 20. The slot may take any shape (e.g., line, cross, etc.). Further, one or more cross groves may be implemented that assist the opening of slot 60, but do not themselves open to the outside atmosphere. For example, in a cross-shape configuration, as illustrated, one open cross arm slot 60 may vent pressure from inside container 10, 11 to outside, while the other cross arm (shown perpendicular to slot 60) has a shallow cut (e.g., 0.2 mm) that does open up to the outside environment, but rather lessens tension in the silicone material such that slot 60 has the proper tension to selectively open when desired in order to properly function as a normally sealed pressure relief valve.

In the embodiment having a thinner silicone portion of venting aperture 20, compared to the thickness of lid 15, the thinner surface better allows the venting aperture 20 to release pressure build-up within container 10 (i.e., it takes less pressure to open slot 60 of venting aperture 20 than if venting aperture 20 was of equal thickness to lid 15). Further, while silicone material is usually difficult to tear or destroy, the thinner silicone material that comprises venting aperture 20 may be more susceptible to tearing than lid 15.

Barrier/perimeter 55 provides a ring around this thinner portion to reduce any shearing forces which might ordinarily occur and attempt to isolate this structure. However, in the event of a tear of slot 60 or venting aperture 20, which might be caused intentionally or by unconventional force being applied, barrier/perimeter 55 would prevent the tear from elongating and further tearing lid 15, thereby rendering the container unusable. While tearing of slot 60 or venting aperture 20 could result in a slight decrease in performance of container 10, such as in its ability to perfectly seal, it would still allow for container 10 to store food.

The barrier/perimeter 55 may protrude from the inner surface of lid 15. Although not shown in FIG. 5, on the outer surface of lid 15, the venting aperture 20 may be flush with said surface. Alternatively, venting aperture 20 may not be flush with the outer surface of lid 15. For example, the venting aperture may be indented relative to the outer surface of lid 15.

Figure 6:
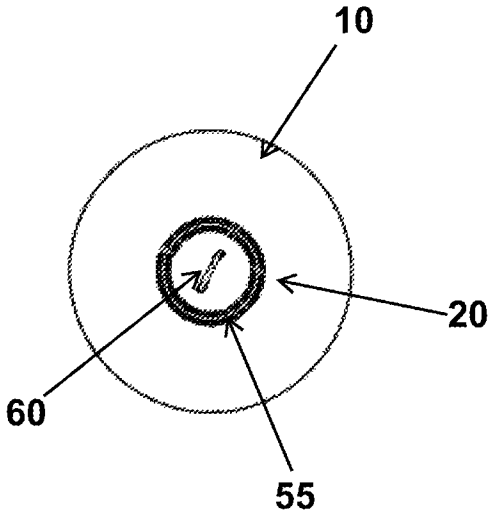
FIG. 6 is a close-up view of a venting aperture according to another embodiment of the present invention.

FIG. 6 is a zoomed-in view showing only the venting aperture 20 of container 10 (or container 11) from the perspective of the inner surface of the lid 15, according to another embodiment thereof. As illustrated, venting aperture 20 is defined by a barrier/perimeter 55. The surface within barrier 55 comprises the venting aperture 20. According to this embodiment, venting aperture 20 includes only a single linear slot 60 that is cut through the entire thickness of venting aperture 20.

The novel self-venting food storage container 10 shown in FIGS. 1 through 4, is formed principally or entirely from silicone—a synthetic elastomer. The container 10 may be formed by suitable manufacturing methods such as injection molding and the like. Silicone is a low taint, non-toxic material, which meets the necessary requirements when contact with food is required. Silicone is already an important product in the cookware industry, particularly bakeware and kitchen utensils, where rigidity is not a primary concern. It is used as an insulator in heat resistant potholders and similar, however it is more conductive of heat than the less dense fiber-based ones. Silicone oven mitts are able to withstand temperatures up to 357° C. (675° F.), and allow reaching into boiling water. According to the illustrated embodiments, container 10 utilizes silicone within the same parameters as set forth by the FDA with respect to specified thickness and durometer.

Nevertheless, other pliable materials may be utilized without departing from the scope of the present invention.

Furthermore, the self-venting containers 10 may be customized or personalized, such as by the inclusion of a logo on container 10. The unique properties of silicone allow the ability to apply printed or embedded physical logos to the outside surface or any other surface of the container 10. Using appropriate inks and processes, these products can receive a variety of designs.

Additionally, the silicone utilized can be produced in any Pantone color, or without pigment so as to be rendered nearly translucent. It is also possible to add to the raw material an additive that renders the finished container 10 phosphorescent (i.e., glow in the dark).

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A self-venting food storage container comprising:

a lid permanently attached to a base via a connecting member, wherein the base has at least one sidewall extending from said base a bottom forming a receptacle for storing food, wherein the sidewall has a rim, wherein the lid has a recess configured to selectively receive the rim of said base, such that connecting of said rim to said recess seals the container, wherein the lid has a thickness and a venting aperture, wherein the venting aperture has a thickness thinner than the thickness of the lid;

wherein the lid and the venting aperture are each part of a single unitary structure formed from silicone, and wherein the venting aperture has a normally sealed slot cut through the lid configured to release pressure-build up in the container.

2. The self-venting food storage container of claim 1, wherein the food storage container is made entirely of silicone.

3. The self-venting food storage container of claim 2, wherein the silicone is food-grade silicone.

4. The self-venting food storage container of claim 1, wherein the inner surface of the receptacle is smooth.

5. The self-venting food storage container of claim 1, wherein the inner surface of the lid has a smooth finish.

6. The self-venting food storage container of claim 1, wherein the base and the lid have the same shape.

7. The self-venting food storage container of claim 6, wherein the base and the lid are circular.

8. The self-venting food storage container of claim 6, wherein the base and the lid are rectangular.

9. The self-venting food storage container of claim 1, wherein the outer surfaces of the container have a grip-enhancing texture.

10. The self-venting food storage container of claim 1, wherein the venting apparatus is bound by a barrier and the barrier has a thickness thicker than the thickness of the lid.

11. The self-venting food storage container of claim 1, wherein the connecting member has a utensil receptacle configured to store utensils.

12. The self-venting food storage container of claim 1, wherein the connecting member has at least one folding line.

13. The self-venting food storage container of claim 1, wherein the slot of the venting aperture acts as a normally closed pressure relief valve.

14. The self-venting food storage container of claim 1, wherein the slot is shaped as a cross.

15. The self-venting food storage container of claim 1, wherein only one of the arms of the slot is cut through the entire thickness of the venting aperture.

16. The self-venting food storage container of claim 1, wherein the inner surface of the receptacle includes graduated marks.

17. A self-venting food storage container comprising:

a lid and a base, wherein the base has at least one sidewall extending from said base forming a receptacle for storing food, wherein the lid is selectively couplable to the base by a connecting member, wherein the lid has a thickness and a venting aperture, such that the thickness is determined at a location immediately adjacent to the venting aperture, wherein the entire venting aperture has a thickness thinner than the thickness of the lid and is enclosed by a barrier having a thickness thicker than the thickness of the lid, and wherein the venting aperture is made from a pliable material having a slot configured to release pressure-build up in the container; and wherein when the food storage container is in an open configuration, the lid, the connecting member, and the base are all co-planar.

18. The self-venting food storage container of claim 17, wherein the venting aperture is made from silicone.

19. The self-venting food storage container of claim 18 wherein the entire lid is made from silicone.

* * * * *